US010168086B2

(12) United States Patent
Cowans

(10) Patent No.: US 10,168,086 B2
(45) Date of Patent: Jan. 1, 2019

(54) TEMPERATURE CONTROL SYSTEM WITH PROGRAMMABLE ORIT VALVE

(71) Applicant: B/E Aerospace, Inc., Wellington, FL (US)

(72) Inventor: Kenneth W. Cowans, Fullerton, CA (US)

(73) Assignee: B/E Aerospace, Inc., Wellington, FL (US)

( * ) Notice: Subject to any disclaimer, the term of this patent is extended or adjusted under 35 U.S.C. 154(b) by 453 days.

(21) Appl. No.: 14/327,402

(22) Filed: Jul. 9, 2014

(65) Prior Publication Data

US 2015/0013366 A1 Jan. 15, 2015

Related U.S. Application Data

(60) Provisional application No. 61/845,814, filed on Jul. 12, 2013.

(51) Int. Cl.

| | |
|---|---|
| ***F25B 1/00*** | (2006.01) |
| ***F25B 41/00*** | (2006.01) |
| ***F25B 41/04*** | (2006.01) |
| ***F25B 49/02*** | (2006.01) |

(52) U.S. Cl.

CPC ..... *F25B 41/043* (2013.01); *F25B 1/005* (2013.01); *F25B 41/00* (2013.01); *F25B 49/02* (2013.01); *F25B 2400/13* (2013.01); *F25B 2600/2513* (2013.01)

(58) Field of Classification Search

CPC ..... F25B 41/043; F25B 1/005; F25B 41/00; F25B 49/02; F25B 2400/13; F25B 2600/2513; F25B 2313/0311; F25B 2341/065; F25B 2341/068; F25B 2700/191; F25B 2400/16; F25B 2500/26; F25B 2600/25; F25B 2600/2509; F25B 2700/21; F25B 2700/2104; F25B 2700/21174

USPC ..... 62/222, 197

See application file for complete search history.

(56) References Cited

U.S. PATENT DOCUMENTS 3,482,415 A * 12/1969 Trask ..... F25B 13/00 137/538
4,332,145 A * 6/1982 Yuhasz ..... A23G 9/281 62/342
5,655,379 A * 8/1997 Jaster ..... F25B 41/065 137/392

(Continued)

OTHER PUBLICATIONS

International Search Report, dated Oct. 6, 2014, 3 pages, from PCT/US2014/046227.

*Primary Examiner* — Ned Landrum
*Assistant Examiner* — Daniel C Comings
(74) *Attorney, Agent, or Firm* — Donna P. Suchy

(57) ABSTRACT

A temperature control system employing a two-phase refrigerant and a compressor/condenser loop is disclosed wherein a two phase refrigerant condenses within the load, the system including a thermo-expansion valve that simultaneously allows refrigerant flow through the thermo-expansion valve and regulates a temperature of the refrigerant in its two phase state ahead of the thermo-expansion valve, and wherein a flow through the thermo-expansion valve occurs only after a pressure and temperature upstream of the thermo-expansion valve reaches a final temperature and pressure.

8 Claims, 5 Drawing Sheets

(56) References Cited

U.S. PATENT DOCUMENTS

| | | | | | |
|---|---|---|---|---|---|
| 5,729,985 | A * | 3/1998 | Yoshihara | F25B 13/00 | 62/81 |
| 5,951,115 | A * | 9/1999 | Sakai | B60T 8/267 | 303/152 |
| 6,209,793 | B1 * | 4/2001 | Taguchi | F25B 41/062 | 236/92 B |
| 7,415,835 | B2 * | 8/2008 | Cowans | F25B 41/00 | 62/190 |
| 2002/0023447 | A1 * | 2/2002 | Podtchereniaev | C09K 5/045 | 62/217 |
| 2005/0183432 | A1 * | 8/2005 | Cowans | F25B 41/00 | 62/190 |
| 2009/0071177 | A1 * | 3/2009 | Unezaki | F25B 13/00 | 62/196.1 |
| 2015/0337831 | A1 * | 11/2015 | Zhou | F24F 11/001 | 700/276 |

* cited by examiner 135
145

Danfoss SV
1S C
100
125
TXV cold
5S O
Δ P
Load ESC
H2 O Hex
EPC HEX
New capacitor
ORIT controller
Liquid thermistor
E-ORIT
Receiver
T
ΔP
Ck
4S
CRO'
190
Pout ≤ 8 atm.
23D
11D
23D
24D

TEMPERATURE CONTROL SYSTEM WITH PROGRAMMABLE ORIT VALVE

CROSS-REFERENCES TO RELATED APPLICATIONS

This application claims priority from U.S. Provisional Patent Application No. 61/845,814, filed Jul. 12, 2013, the contents of which are incorporated herein by reference in its entirety.

BACKGROUND

Thermal control units (TCUs), such as heating and chilling systems are widely used to establish and maintain a process tool or other device at a selected and variable temperature. Typical examples of a modem thermal or temperature control unit are found in highly capital intensive semiconductor fabrication facilities. Stringent spatial requirements are placed on the TCUs, in order to preserve expensive floor space as much as possible. Reliability must be assured, because the large capital equipment costs required do not tolerate downtime in operation if profitable performance is to be obtained. The target temperature may be changed for different fabrication steps, but must be held closely until that particular step is completed. In many industrial and common household refrigeration systems, the purpose is to lower the temperature to a selected level, and then maintain the temperature within a temperature range that is not highly precise. Thus even though reliable and long-lived operation is achieved in these commercial systems, the performance is not up to the demands of highly technical production machinery.

In most modern TCUs, actual temperature control of the tool or process is exercised by use of an intermediate thermal transfer fluid which is circulated from the TCU through the equipment and back again in a closed cycle. A thermal transfer fluid is selected that is stable in a desired operating range below its boiling temperatures at the minimum operating pressure of said fluid, and must also have suitable viscosity and flow characteristics within its operating range. The TCU itself employs a refrigerant, usually an ecologically acceptable type, to provide any cooling needed to maintain the selected temperature. The TCU may circulate the refrigerant through a conventional liquid/vapor phase cycle. In such cycles, the refrigerant is first compressed to a hot gas at high pressure level, and then condensed to a pressurized liquid. The gas is transformed to a liquid in a condenser by being passed in close thermal contact with a cooling fluid; where it is either liquid cooled by the surrounding fluid or directly by environmental air. The liquid refrigerant is then lowered in temperature by expansion through a valve to a selected pressure level. This expansion cools the refrigerant by evaporating some of the liquid, thereby forcing the liquid to equilibrate at the lower saturation pressure. After this expansive chilling, the refrigerant is passed into heat exchange relation with the thermal transfer fluid to cool said thermal transfer fluid, in order to maintain the subject equipment at the target temperature level. Then the refrigerant is returned in vapor phase to the pressurization stage. A source of heating must usually be supplied to the thermal transfer fluid if it is needed to raise the temperature of the circulated thermal transfer fluid as needed. This is most often an electrical heater placed in heat exchange with the circulated fluid and provided with power as required.

Such TCUs have been and are being very widely used with many variants, and developments in the art have lowered costs and improved reliability for mass applications. In mass produced refrigerators, for example, tens of thousands of hours of operation are expected, and at relatively little cost for maintenance. However, such refrigeration systems are seldom capable of operating across a wide temperature range, and lower cost versions often use air flow as a direct heat exchange medium for the refrigerated contents.

The modern TCU for industrial applications has to operate precisely, e.g., a typical requirement being .+/−.<1. degree. C., at a selected temperature level, and shift to a different level within a wide range (e.g. −40.degree. C. to +60.degree. C. for a characteristic installation). Typical thermal transfer fluids for such applications include a mixture of ethylene glycol and water (most often in deionized form) or a proprietary perfluorinated fluid sold under the trademark "Galden" or "Fluorinert". These fluids and others have found wide use in these highly reliable, variable temperature systems. They do not, however, have high thermal transfer efficiencies, particularly the perfluorinated fluids, and impose some design demands on the TCUs. For example, energy and space are needed for a pumping system for circulating the thermal transfer fluid through heat exchangers (HEXs) and the controlled tool or other equipment. Along with these energy loss factors, there are energy losses in heat exchange due to the temperature difference needed to transfer heat and also losses encountered in the conduits coupling the TCU to and from the controlled equipment. Because space immediately surrounding the device to be cooled is often at a premium, substantial lengths of conduit may be required, which not only introduces energy losses but also increases the time required to stabilize the temperature of the process tool. In general the larger the volume of the TCU, the farther the TCU needs to be located remotely from the device to be controlled. The fluid masses along the flow paths require time as well as energy to compensate for the losses they introduce. Any change in temperature of the device to be controlled must also affect the conduits connecting the TCU and the controlled device along with the thermal transfer fluid contained in said conduits. This is because the thermal transfer fluid is in intimate thermal contact with the conduit walls. Thus, the fluid emerging at the conduit end nearest the controlled device arrives at said device at a temperature substantially equal to that of the conduit walls, and these walls must be changed in temperature before the controlled device can undergo a like change in temperature.

To the extent that straightforward refrigeration systems may have in the past employed a refrigerant without a separate thermal transfer fluid, it has been considered that the phase changes imposed during the refrigeration cycle prohibit direct use of the refrigerant at a physical distance outside the cycle. A conventional refrigerant inherently relies on phase changes for energy storage and conversion, so that there must also be a proper state or mix of liquid and vapor phases at each point in the refrigeration cycle for stable and reliable operation of the compressor and other components. Using a saturable fluid such as a refrigerant directly in heat exchange with a variable thermal load presents formidable system problems.

Various systems for temperature control have been proposed that depart from the traditional two phase vapor cycle, including those described in U.S. Pat. No. 7,178,353 and U.S. Pat. No. 7,415,835 to inventors Kenneth W. Cowans et al. This departure is directed to a novel temperature control system which combines flows of refrigerant in a hot gas pressurized mode with the same refrigerant in an expanded vapor/liquid mode. The system combines some expanded refrigerant flow with a suitable proportion of pressurized hot gas in a closed circuit vapor-cycle refrigeration system. The combined refrigerant stream generated can exchange thermal energy directly with a load, as in a heat exchanger (HEX). Such systems offer substantial benefits in improving heat transfer efficiency and economy and in enabling rapid and precise temperature level changes. Since they require no intermediate coolant and the pressure can be varied rapidly, this approach, which for succinctness has sometimes been termed TDSF for "Transfer Direct of Saturated Fluids," offers distinct operative and economic advantages for many temperature control applications.

U.S. Pat. No. 7,415,835 assigned to the present assignee, the contents of which are fully incorporated hereby by reference, introduced a system that employs the high thermal transfer efficiency of a refrigerant mixture of liquid and vapor in a system capable of very fast temperature change response. A benefit of that system was that it eliminated the need for substantial delay times to correct temperature levels at the device being controlled, as well as for substantial energy losses in conduits and heat exchangers, and the need for substantial time delays in shifting between target temperatures at different levels.

The trapped ramp system employs four modes in its operation: Ramp-up, Regulation, Stand-by, and Ramp-down. In the Ramp-up mode, the electrostatic chuck is heated rapidly from one regulated temperature to a higher temperature. In the Regulation phase, a large amount of radio frequency (RF) energy is cooled during processing. The electrostatic chuck is regulated in the Stand-by phase at a temperature but the system is called on to supply heat. In the Ramp-down mode, the electrostatic chuck is cooled rapidly from one regulated temperature to a lower temperature.

U.S. patent application Ser. No. 13/651,631 to Cowans et al., incorporated fully herein by reference, discusses improvements in vapor cycle systems used for refrigeration or heat exchange that can be realized by modifying the conventional vapor cycle (FIG. 2), having to incorporate an additional thermal exchange step after expansion of compressed condensed refrigerant (FIG. 3). This interchange of thermal energy is then between the expanded refrigerant and the return flow from the evaporator and is accompanied by a controlled pressure drop, which introduces enhanced post condensing (EPC). The post condensation lowers the quality level (ratio of vapor mass to total mass) of refrigerant delivered to the evaporator and raises the effective heat transfer coefficient during energy exchange with the load. This expedient increases the bulk density of the mass moving through the evaporator and lowers the pressure drop introduced, minimizing heat transfer losses in the low efficiency region of the evaporator. The controlled pressure drop, provided by a pressure dropping device, introduces a substantially constant pressure difference to assure that no expanded vapor and liquid flows during those times when maximum heating is desired.

The expanded liquid/vapor mix feeds pressurized input to one side of a two-phase heat exchanger prior to the evaporator; the heat exchanger also receives a flow of output derived from the evaporator after having serviced the load. A pressure dropping valve introduces a temperature drop of the same order of magnitude in the two-phase mixture as the mass superheat used to regulate the cooling temperature with the thermal expansion valve. This temperature drop thusly created drives heat to pass from one flow in the heat exchanger to the other flow. Consequently, by introduction of a relatively small heat exchanger and a pressure dropping device in a given temperature control unit an overall gain in H is achieved. This results in a net gain in efficiency.

Application of this principle to TDSF systems employs the flow of fluids through a supplemental heat exchanger that is generally relatively smaller than the load, and also employs a pressure dropping valve to make a temperature difference available to drive heat across said supplemental heat exchanger so as to introduce further condensation. This combination uniquely effects TDSF system operation by acting to limit and smooth out deviations in temperature changes as well as increasing system efficiency. Small changes in temperature level can be introduced by precise valve regulation of the flow of hot gas into the mixture.

If a slightly higher temperature is needed and/or operation is to be at a low flow or power level, the situation is different, because the pressurized hot gas source presents a much larger potential energy input (than does condensed liquid vapor input after expansion) so that stability and precision can be problematic if temperature is to be raised a relatively small amount. In this situation, employment of enhanced post condensation is effective in changing the flow rate of pure gaseous medium at high pressure so that the control of temperature becomes much more precise particularly at higher temperatures where it may be necessary to heat and cool alternately in order to control temperature. The heat exchanger and pressure dropping valve in the flow path compensate for nonlinearity in thermal energy exchange by smoothing the rate of change of temperature increase and ensuring thermodynamic balance. Employing EPC in the TDSF context, therefore, assures that a higher, stable temperature level can be attained more rapidly regardless of the increment of change and the power level involved.

FIG. 3 illustrates the repumping mechanism consistent of a check valve and pump plumbed in between the input and output of an evaporator in a vapor-cycle system. The pump is used when it is desirable or necessary to increase the heat transfer coefficient within the evaporator. When the pump is not turned on, the vapor cycle system functions as if the repumping system was not installed. In FIG. 4, both the repumping system is used with the enhanced post-condensing. In the combined system, the repumping is turned on when the output at the evaporator is changing rapidly from one temperature to another. In this ramping process, the enhanced post condensing enhancement of efficiency, particularly on a vapor cycle system that has been retrofitted with an EPC system that includes a smaller compressor, may not increase the speed of ramping. This is because the smaller compressor will flow less mass across the evaporator and thus have a smaller heat transfer coefficient, particularly while the load temperature is being changed.

FIG. 5 shows a graph documenting data about the heat transfer coefficient within the evaporator of a vapor cycle refrigerator or heat pump using the refrigerant R22, which is representative of other refrigerants. The data shows how the enhanced post condensing augments the vapor cycle efficiency. The function of the EPC is to eliminate the sharp drop off of the heat transfer coefficient with a two-phase quality of around eighty percent (80%) or more. As seen in FIG. 5, the heat transfer coefficient is very sensitive to the mass velocity within the evaporator. The characteristic of the curves shown in FIG. 5 illustrate the effect of velocity. As the liquid boils to gas the velocity increases due to the fact that the gas phase is considerably less dense. As a result, FIG. 5 shows a monotonically increasing heat transfer coefficient as quality increases due to liquid being boiled to a gas until quality exceeds about 80%. Thereafter, the heat transfer quality drops precipitously, becoming equal to that of pure gas at the outlet of the conventional evaporator.

The vapor cycle is used as the driving system in a temperature control unit such as that discussed above. The temperature control systems based on the principles discussed in U.S. Pat. No. 7,178,353 and U.S. Pat. No. 7,415,835 discussed above, refer to the transfer direct of saturated fluids, or TDSF. The TDSF is the basis, in turn, for the trapped ramp (TR) system set forth in U.S. patent application Ser. No. 13/651,631 (discussed above). That is, the trapped ramp system is based, for heating an electrostatic chuck rapidly up to a high temperature, on a TDSF using a stream of hot high pressure gas condensing within an electrostatic chuck, flowing from said electrostatic chuck through a valve that opens On Rise of Input Temperature (ORIT valve, or "ORIT") which thereafter regulates the temperature of the electrostatic chuck. It regulates the temperature by controlling pressure due to the inherent nature of saturated fluids.

As the trapped ramp system is used to rapidly heat (ramp up) the load, the condensing gas will not flow through until the pressure ahead of the ORIT reaches regulated temperature. This can cause the fluid to back up within the load, thereby diminishing the area available for condensing the gas. As a consequence, the rate of heating slows. The repumping system counteracts this deceleration. As the pump of the repumping activates, it forces a flow through the load, in this case the electrostatic chuck. In turn, this action allows the incoming hot gas to condense as it passes through the electrostatic chuck, thus allowing for more rapid heating.

SUMMARY OF THE INVENTION

When testing the trapped ramp system ramping from a lower temperature to a higher temperature (ramp-up), it was noted that the initial ramp rate was approximate to the calculated rate (refrigeration power plus compressor power heating the measured ESC, about 5° C./sec), the rate quickly slowed and behaved in a manner difficult to explain. It was determined that the ramp-ups are carried out with refrigerant condensing within the load ESC until the open-on-rise-of-inlet-temperature (ORIT) valve simultaneously allows refrigerant flow through said ORIT and regulates the temperature of the refrigerant in its two phases state ahead of the ORIT. The flow through the ORIT occurs only after the pressure/temperature ahead of the ORIT reaches design final high temperature and pressure. The foregoing suggested this flow stoppage was responsible for the slowdown in ramp rate. The liquid build-up within the electrostatic chuck stopped condensing wherever the liquid obstructed flow. The present invention adds a volume capacitance downstream of the electrostatic chuck to allow liquid to collect in the capacitance. After the pressure attains its target value, flow is established through the OUT as it is designed. In a preferred embodiment, a liquid thermistor and a delta pressure valve are included to the system.

To avoid the build-up of fluid in the system, the ORIT must be controlled to open gradually during the heat-up phase to allow fluid to gradually enter the capacitor. The present invention introduces a controllable slope to the operation of the ORIT valve, preventing a buildup of liquid refrigerant during the heat-up phase. For example, the ORIT valve can be programmed to open linearly between a pressure of the refrigerant at a starting temperature and a pressure of the refrigerant at a final temperature. By opening the ORIT valve gradually and consistently over the range of pressures during the heat-up phase, no mass will accumulate in either the ramp-up or ramp-down modes.

These improvements and other advantages of the present invention will be best understood in conjunction with the drawings and the detailed description of the preferred embodiments set forth below.

DETAILED DESCRIPTION OF THE PREFERRED EMBODIMENTS

Figure 1:
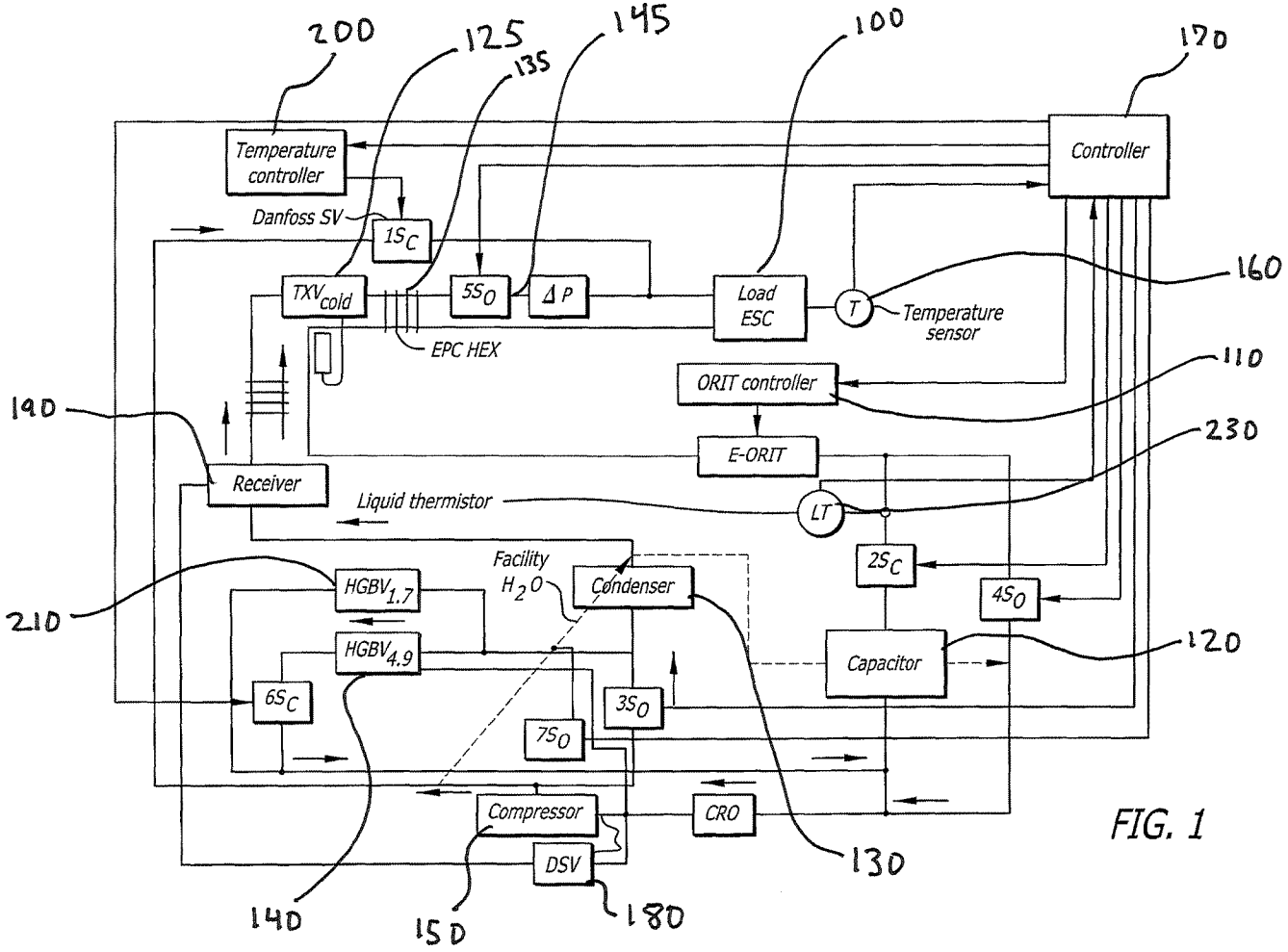
FIG. 1 a schematic of a trapped ramp temperature control system.
Figure 2:
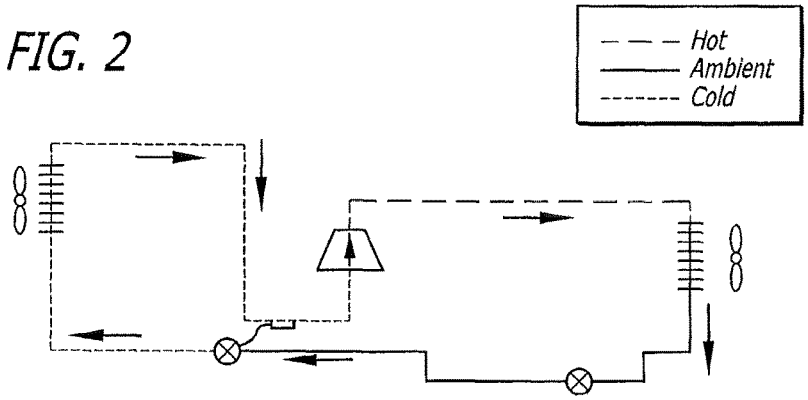
FIG. 2 is a schematic of a vapor cycle.
Figure 3:
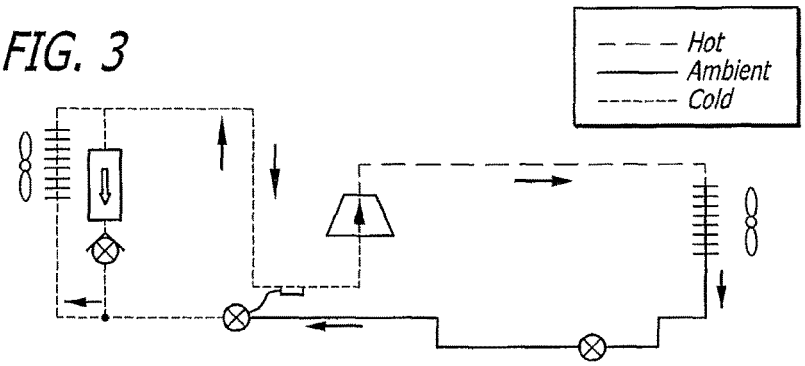
FIG. 3 is a schematic of a vapor cycle with repumping.
Figure 4:
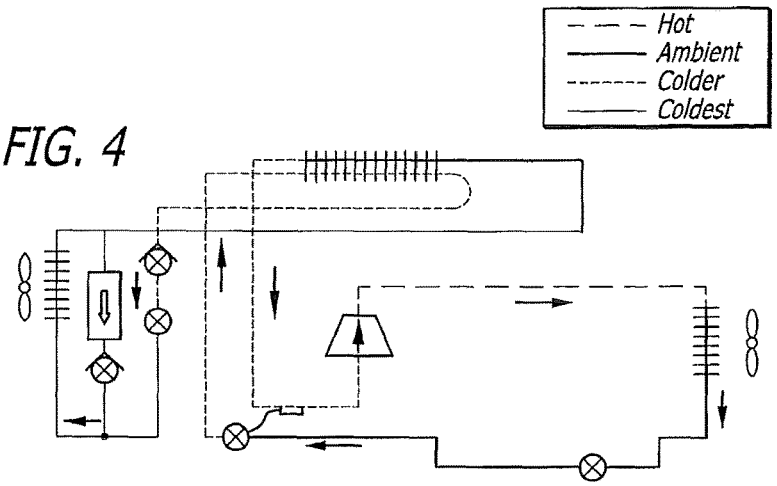
FIG. 4 is a schematic of a vapor cycle with repumping and enhanced post condensing.
Figure 5:
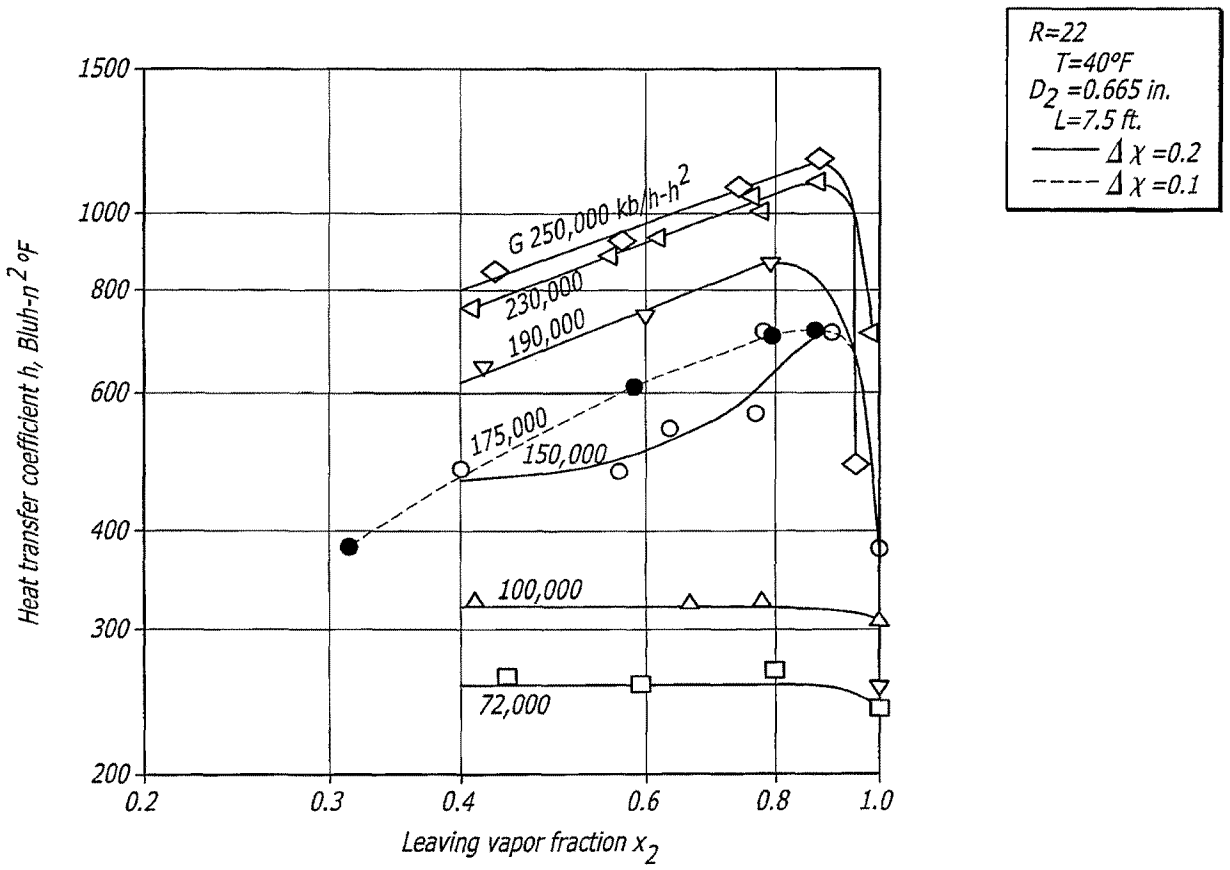
FIG. 5 is a graph showing behavior of heat transfer coefficients.

FIG. 1 illustrates the temperature control system featuring the trapped ramp technology. It utilizes four modes: Ramp-up, Regulation, Stand-By, and Ramp-down. Each of these modes are set forth in greater detail below with respect to FIG. 1. While a complete description of the operation is disclosed in United States Patent Publication No. 2013/0036753, incorporated herein by reference, the details pertinent to the present invention are discussed below.

In FIG. 1, the system comprises a vapor cycle refrigeration system having a conventional compressor 150 which feeds a high pressure, high temperature output as a pressurized gas to a condenser 130. The condenser 130 reduces the refrigerant temperature to a primarily liquid state at ambient or near ambient temperature. The condenser 130 may be liquid or air cooled, and may use a regulated coolant control or be unregulated. The liquefied pressurized product from the condenser 130 is input to an externally equalized thermal expansion valve (hereafter TXV) 125. TXV 125 has a conventional internal diaphragm (not shown) whose position determines the amount of flow through TXV 125.

The expanded output of TXV 125 is delivered one input to a subsidiary HEX 135 in the refrigerant path leading to the evaporator, which is the load 100. In the subsidiary HEX 135 the expanded fluid from the TXV flows in heat exchange relation with returned refrigerant from the system load (evaporator) 100 that ultimately feeds the suction input line to the compressor 150. This return line from the load 100 through the HEX 135 to the compressor 150 input therefore forms part of a subsidiary heat exchange loop configured and operated to provide improved heat transfer. In this subsidiary loop to the evaporator 100, the outflow from the TXV 125 first passes through HEX 135 and then a pressure valve 145. The pressure valve 145 induces a temperature drop that approximates the difference between the evaporating refrigerant and the load being cooled, since the evaporator 100 superheat is a factor critical to stable operation.

In operation, the system of FIG. 1 provides the basic compression and condensation functions of a vapor cycle system, feeding the liquefied, pressurized refrigerant to the TXV 125, which then controls the expansion, consequently the major amount of cooling, of the refrigerant. A capillary having a fixed aperture and pressure drop may alternatively be used, but the TXV 125 is more functional in systems which are designed for high efficiency.

In the EPC HEX 135 the thermodynamic cycle undergoes a fundamental variation from the usual cycle, exchanging thermal energy between the return flow from and the input flow to the evaporator 100. The input flow temperature is then dropped as refrigerant passes through the adjacent pressure valve 145. Within this subsidiary heat exchange loop, the thermal energy on the outgoing flow and points in the return flow is effectively substantially equal. However, this makes possible enhanced post condensation. The refrigerant in boiling its liquid provides enough cooling to condense liquid on the other side of HEX 135 to reduce the enthalpy of the input refrigerant. This heat transfer is driven by the temperature difference, which is created by the effect of pressure dropping valve 145. The pressure drop in the valve 145 lowers the temperature. The combined effect of the HEX 135 and the valve 145 reduces the quality (vapor mass percentage to total mass percentage) of the refrigerant that is delivered to the load 100.

1. Ramp-Up Mode:

The "Load ESC" 100 is ramped to a high temperature with the opening of solenoid valve 1$S_C$, 2$S_C$, 6$S_C$ and the closing of 3$S_O$, 4$S_O$, 7$S_O$. This puts the compressor output directly to the ESC 100 wherein it condenses. The "E-ORIT" 110 has been set to the high temperature goal for the ESC 100 simultaneously with the start of ramp-up. The capacitor 120 has been heated during normal regulation mode by accepting cooling water from the "Condenser" 130 after said cooling water has heated by absorbing the heat of refrigerant condensation during the previous regulation phase. In the capacitor 120, liquid is evaporated by the heat stored in the capacitor after refrigerant flows through the E-ORIT 110. The hot gas bypass valve 140 ensures that flow to the compressor 150 is at a pressure of 4.9 bar, which is the maximum input pressure the compressor 150 in this example can safely allow. The hot gas bypass valve ("HGBV") 140 is prompted to supply gas when the sensing line to the HGBV detects that the input pressure to the compressor is less than 4.9 bar. When the load ESC 100 gets to the set temperature the temperature sensor 160 signals the controller 170 which then shuts valve 1$S_C$ and opens valve 3$S_O$, switching the system into regulation mode at the higher temperature. Valve 2$S_C$ remains open until all liquid emerging from the load ESC 100 through the E-ORIT 110 flows through the capacitor 120. Thereafter, valve 4$S_O$ opens and valve 2$S_C$ closes. The desuperheater ("DSV") 180 cools the compressor input as needed. A receiver 190 is placed in the line after all the connections to both HGBV 140 and DSV 180. The receiver 190 supplies the DSV 180 with liquid refrigerant.

2. Regulation During Processing Mode:

After valve 2$S_C$ is closed and valve 3$S_O$ is opened following the closing of 1$S_C$, and processing with RF energy applied to the load ESC 100, the system operates as an advanced TDSF with primary control of temperature provided by the E-ORIT 110. Refrigeration is reduced to a minimum by operation of the E-ORIT 110 which drops the pressure at the compressor input until the refrigeration needs of the ESC are balanced by the output of the refrigeration circuit. If the regulation occurs with the ESC 100 at a temperature below 15° C., solenoid valve 7$S_O$ is allowed to open. This operation allows the cooling water to cool the condenser to 50° C. Such operation is needed to protect the compressor 150: An input pressure as low as 1.7 bar can only be safely compressed to 4.9 bar.

3. Stand-By Mode:

A situation can exist just following ramp-up wherein heat must be supplied to the load ESC 100 while the ESC is in regulation mode. This can occur if the ESC is held in a standby mode with no RF energy applied to the ESC. In this case the temperature sensor 160 signals the controller 170 that the ESC 100 is cooling below the desired regulated temperature. The controller 170 then signals such to the temperature controller 200 which then pulses valve 1$S_C$, in order to supply an appropriate amount of heat to the ESC 100. This operation will occur whenever the system is in regulation mode and sufficient RF power is not present to maintain the ESC 100 at its set temperature. As noted, this will generally happen when the ESC process is in standby mode.

4. Ramp-Down Mode:

Following regulation at a high temperature, ramp-down is initiated simply by adjusting the E-ORIT 110 to the lower temperature. Regulation follows ramp-down by action of the E-ORIT valve. If the low temperature desired is below 15° C. some further modifications to system setup are needed. Valve 6$S_O$ need be closed., and this action allows the hot gas bypass valve 210 to allow the temperature of the refrigerant to reach 0° C. which occurs for R134A at 2.93 bar absolute. The setting of a 1.7 bar gage allows for some pressure drop between ESC 100 and the compressor 150 input. Cooling water valve at 50° C. must be allowed to control. Typically, compressors cannot compress R134A from 0° C. to >70° C.

Figure 6:
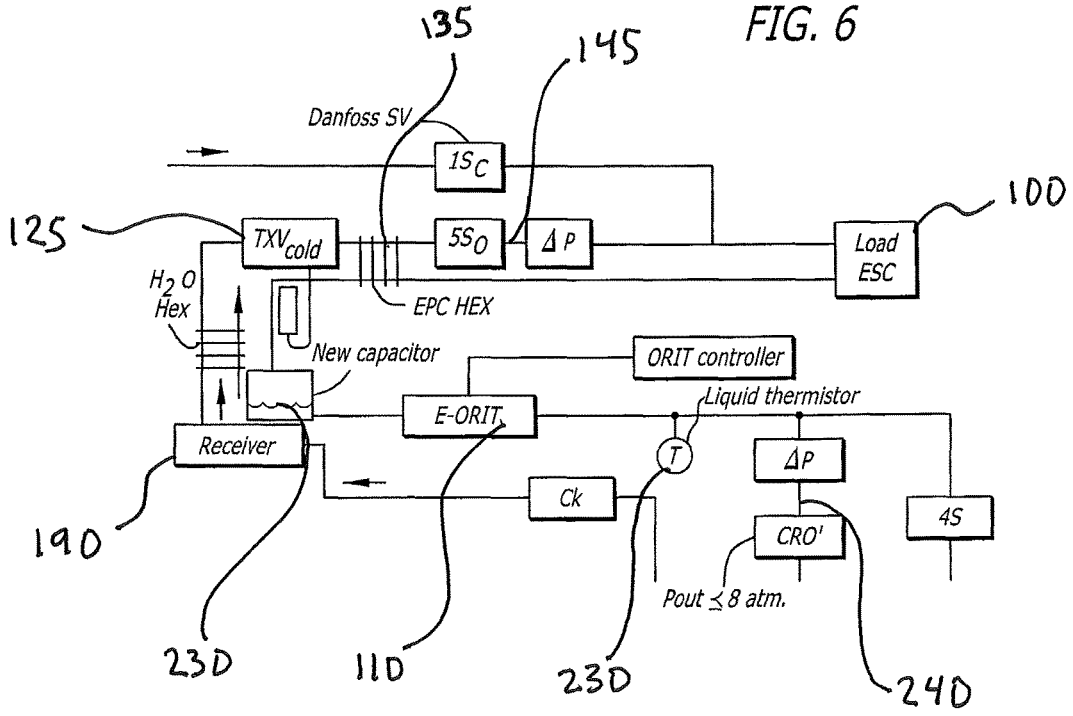
FIG. 6 is a schematic of a temperature control system with a fluid collection upstream of the ORIT valve and liquid detection at the exit of the ORIT valve.

FIG. 6 shows a details of the improvement to the basic TR system discussed herein. A capacitor 220 with an input at the top and an outlet at the bottom is mounted as shown. The capacitor 220 collects fluid that is backed up at the ORIT valve during the ramp-up phase of the cycle. A liquid thermistor 230 is placed at the exit of the ORIT valve to detect the absence of liquid in the line out of the ORIT 110. The thermistor 230 prevents valve 4$S_O$ from opening when regulation mode is invoked. When fluid is present in the capacitor 220, it flows through the ORIT valve 110 and across the pressure valve 240 to the capacitor 120. When liquid is fully emptied from the capacitor 120, said valve 4$S_O$ is allowed to open. The new ΔP valve 240 is set to more than the pressure drop across the piping that includes valve 4$S_O$ when said piping receives maximum flow.

Figure 7:
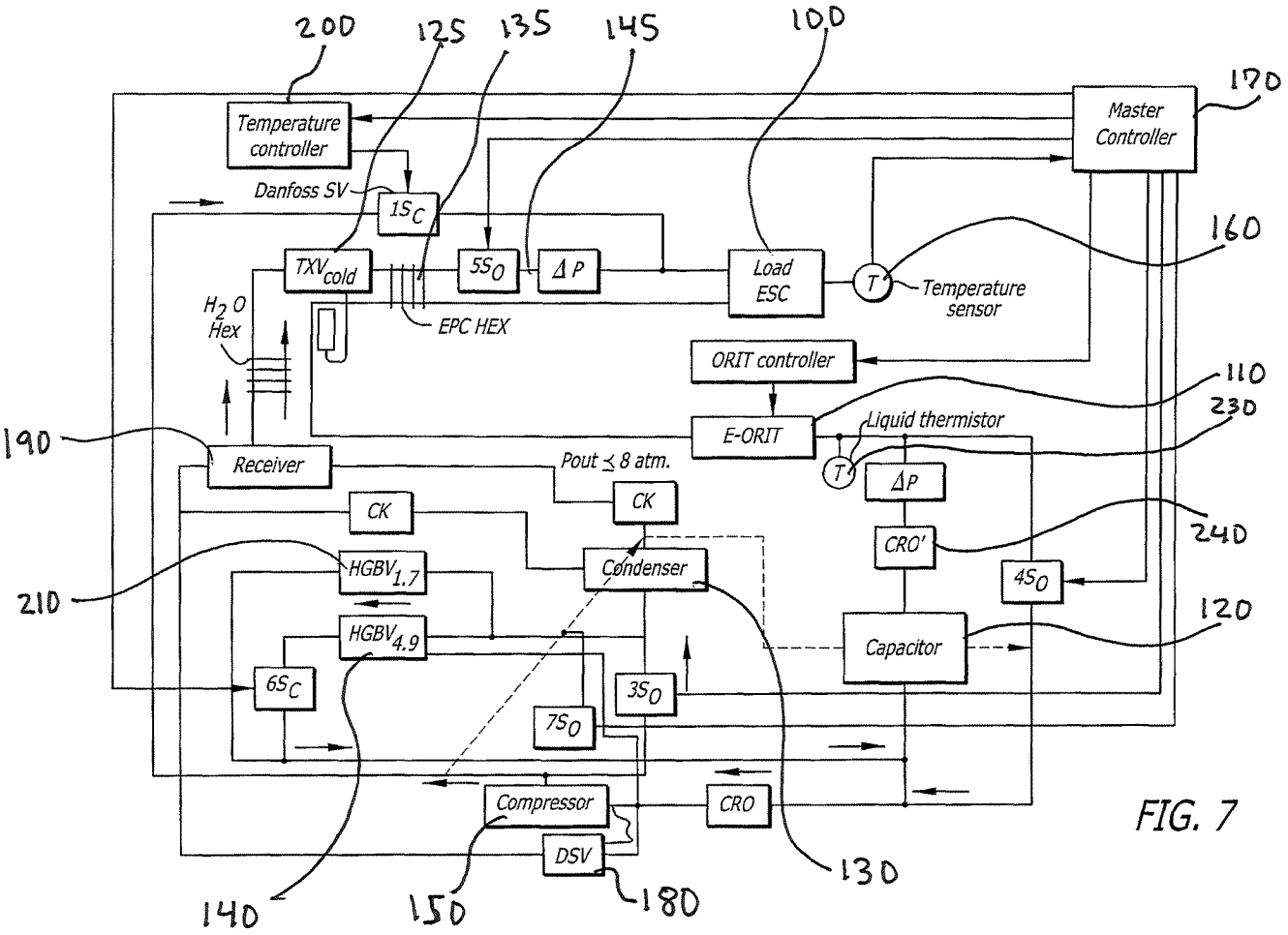
FIG. 7 is a schematic of a trapped ramp temperature control system with fluid collection and liquid detection in the trapped ramp system.

FIG. 7 shows the entire trapped ramp system with the improvements of FIG. 6. The benefit is that it keeps the refrigerant flowing through the electrostatic chuck 100 heating to higher temperatures so that the rapidity of heating can be maintained throughout the operation. This invention collects about 2.5 liters of refrigerant after heating the electrostatic chuck 100 from 0° C. to 70° C. This can create a problem in mass handling since the liquid was not boiled continuously. The mass handling occurs because the ORIT 110 valve during heat-up would not open until the two-phase refrigerant doing the heating reached the set temperature and pressure at which the ORIT is programmed to open.

A solution to the problem outlined above is to program the setting of the ORIT such that the pressure at which the ORIT operated is moved in a predictable manner. For example, the operating pressure could be at 0° C. for R134A (2.93 bar or 28.4 psig) at time zero and ramp in a linear manner over the next twenty five seconds to 70° C. pressure (21.17 bar or 296.5 psig). By doing this, the trapped ramp system could handily operate in steady state during both ramps, up and down, and thus no mass would be accumulated in either mode.

When refrigerant is accumulated in liquid form, it must be stored in gaseous form within the system during those portions of the cycle when the liquid is not accumulated. The volume involved is enormous and it would be impractical to allow for the volume within a usable system. In fundamental thermodynamics terms, the basic TDSF system is able to use the full capability of the compressor to move the heat load rapidly up and down in temperature. It is also able to use only a small portion of the compressor capability, with no adverse effects, during steady-state temperature processing. This combined potential is a basic advantage of the TDSF system. This fundamental characteristic is used to advantage in the basic TR system. The present invention circumvents the problem of accumulating liquid during the heat-up phase of the trapped ramp system.

The sloped ORIT control (SOC) system is beneficial for obtaining rapid and predictable slopes during temperature change to higher temperatures. The refrigerant cannot condense and collect at the load, creating a bottleneck, and the flow can continue in a predictable manner. The flow through the ORIT valve occurs only after the pressure and temperature ahead of the ORIT reaches the design final high temperature and pressure.

Although various improvements and modifications have been shown or described above, the invention is not limited thereto but includes all concepts and expedients within the scope of the appended claims.

I claim:

1. A temperature control system employing a two-phase refrigerant and a compressor/condenser loop having an input and output for circulating the two-phase refrigerant at a controllable temperature to and from a load evaporator having input and output terminals and a known thermal capacity, the temperature control system including a subsidiary flow circuit for enhancing the performance of the system, comprising:

a subsidiary heat exchanger coupled between the flow from the output of the compressor/condenser loop to the load evaporator input, said subsidiary heat exchanger having a first flow path including an input receiving flow from the compressor/condenser loop and an output therefrom coupled to the evaporator input, the subsidiary heat exchanger also including a second flow path in parallel thermal exchange relation along the length of the first flow path, and an output from the subsidiary heat exchanger coupled to the compressor input, the system further includes an open-on-rise-of-inlet-temperature valve disposed in the first flow path between the subsidiary heat exchanger and the input to the load evaporator, a fluid sensing device at the exit from the open-on-rise-of-inlet-temperature valve for sensing flow through the open-on-rise-of-inlet-temperature valve, a capacitor for collecting condensed fluid upstream of the open-on-rise-of-inlet-temperature valve, the system further includes a pressure valve between the load and the compressor, where the pressure valve is in parallel with a solenoid, and the pressure valve opens at a pressure greater than a pressure drop across the solenoid at a maximum flow through the solenoid;

wherein the two-phase refrigerant condenses within the load until the open-on-rise-of-inlet-temperature valve simultaneously allows the two-phase refrigerant flow through the open-on-rise-of-inlet-temperature valve and regulates a temperature of the two-phase refrigerant in the two-phase refrigerant's two phase state ahead of the open-on-rise-of-inlet-temperature valve, and wherein a flow through the open-on-rise-of-inlet-temperature valve occurs only after a pressure and temperature upstream of the open-on-rise-of-inlet-temperature valve reaches a final temperature and pressure; and wherein the system is configured to operate in a ramp-up mode where the load evaporator is ramped up in temperature, a regulation during processing mode where the system operates as a transfer direct of saturated fluids system with control of temperature being provided by the open-on-rise-of-inlet-temperature valve, and a ramp-down mode where the open-on-rise-of-inlet-temperature valve is adjusted to provide a lower temperature of the two-phase refrigerant, wherein the fluid sensing device prevents a valve from opening when the system is operating in the regulation during processing mode, wherein the valve, when opened, allows a flow from the open-on-rise-of-inlet-temperature valve to the compressor, wherein the system is further configured to operate in a stand-by mode, wherein, during operation in the ramp-up mode, the open-on-rise-of-inlet-temperature valve is configured to open linearly between a first pressure of the two-phase refrigerant at a first temperature and a second pressure of the two-phase refrigerant at a second temperature so as to allow liquid refrigerant to enter the capacitor based on the linear opening of the open-on-rise-of-inlet-temperature valve.

2. The temperature control system of claim 1, wherein the open-on-rise-of-inlet-temperature valve is set to actuate at pressures which vary with time.

3. The temperature control system of claim 2, wherein the open-on-rise-of-inlet-temperature valve actuates at a pressure which varies linearly with time.

4. The temperature control system of claim 2, wherein the variance of the pressure with time is selected to prevent the two-phase refrigerant from condensing and collecting at the load evaporator.

5. The temperature control system of claim 1, wherein the fluid sensing device is a liquid thermistor.

6. The temperature control system of claim 1, wherein the capacitor includes an inlet at a top of the capacitor and an outlet at a bottom of the capacitor.

7. The temperature control system of claim 1, wherein the capacitor is configured to collect fluid that is backed up at the open-on-rise-of-inlet-temperature valve during the ramp-up mode.

8. The temperature control system of claim 1, wherein the fluid sensing device allows the valve to open when the capacitor is empty.

* * * * *